US005540285A

United States Patent [19]

Alhamad

[11] Patent Number: 5,540,285

[45] **Date of Patent: *Jul. 30, 1996**

[54] FUEL CONTAINMENT MEDIUM

[76] Inventor: Shaikh G. M. Y. Alhamad, P.O. Box 31590, Riyadh, 11418, Saudi Arabia

[ * ] Notice: The term of this patent shall not extend beyond the expiration date of Pat. No. 5,402,852

[21] Appl. No.: 270,814

[22] Filed: Jul. 5, 1994

Related U.S. Application Data

[60] Continuation-in-part of Ser. No. 806,901, Dec. 13, 1991, which is a division of Ser. No. 674,277, Mar. 19, 1991, Pat. No. 5,097,907, which is a division of Ser. No. 417,696, Oct. 5, 1989, Pat. No. 5,001,017, which is a continuation of Ser. No. 280,317, Dec. 6, 1988, abandoned.

[51] Int. Cl.[6] ..... A62C 3/00; A62C 3/06

[52] U.S. Cl. ..... 169/66; 169/45; 169/69; 220/88.1

[58] Field of Search ..... 169/45, 54, 66, 169/69; 220/88.1

[56] References Cited

U.S. PATENT DOCUMENTS

| | | | |
|---|---|---|---|
| 1,086,707 | 2/1914 | Hoagland . | |
| 1,671,650 | 2/1928 | Newman et al. . | |
| 3,047,184 | 7/1962 | Bergen et al. | 220/88.1 |
| 3,162,231 | 12/1964 | Emerson | 153/2 |
| 3,349,953 | 10/1967 | Conaway et al. | 220/85 |
| 3,356,256 | 12/1967 | Szego | 220/88 |
| 3,475,333 | 10/1969 | Meldrum | 169/66 |
| 3,687,329 | 8/1972 | Baum | 220/26 R |
| 3,822,807 | 7/1974 | MacDonald et al. | 220/88.1 |
| 4,013,190 | 3/1977 | Wiggins et al. | 220/88.1 |
| 4,149,649 | 7/1979 | Szego | 220/88 A |
| 4,224,989 | 9/1980 | Blount | 169/69 |
| 4,249,669 | 2/1981 | Szego | 220/216 |
| 4,265,317 | 5/1981 | Knecht | 169/50 |
| 4,323,118 | 4/1982 | Bergmann | 169/69 |
| 4,361,190 | 11/1982 | Szego | 169/48 |
| 4,405,076 | 9/1983 | Lines, Jr. et al. | 428/921 |
| 4,613,054 | 9/1986 | Schrenk | 220/88 R |
| 4,621,397 | 11/1986 | Schrenk | 29/6.1 |
| 4,925,053 | 3/1990 | Fenton et al. | 220/88.1 |
| 5,123,491 | 6/1992 | Luchs | 169/69 |
| 5,232,308 | 8/1993 | Verstraeten | 169/69 |
| 5,301,722 | 4/1994 | Todd et al. | 141/86 |
| 5,391,019 | 2/1995 | Morgan | 405/128 |

FOREIGN PATENT DOCUMENTS

| | | |
|---|---|---|
| 256239 | 2/1988 | European Pat. Off. . |
| 601374 | 11/1925 | France . |
| 2440892 | 6/1980 | France . |
| 2602976 | 2/1988 | France . |
| 4535457 | 4/1986 | Germany . |
| 2028129 | 3/1980 | United Kingdom . |

OTHER PUBLICATIONS

Geyer, W., "Bringing Storage Tanks to the Surface", Chemical Engineering, p. 94, Jul. 1992.

Ishida, H., "Flame Spread over Fuel–Soaked Ground", Fire Safety Journal 10, 115–123, 1986.

*Primary Examiner*—Andres Kashnikow
*Assistant Examiner*—Virna Lissi Mojila
*Attorney, Agent, or Firm*—Charles E. Cates; Frank T. Barber

[57] ABSTRACT

A highly efficient fuel containment medium which is adapted to protect neighboring facilities against fire or explosion of flammable materials accidentally released from above-ground storage tanks. The fuel containment medium has special applicability for use in diked areas surrounding fuel storage tanks. The medium effectively suppresses flame heights and spread rates in pool fires in said diked areas. The containment medium comprises a mineral aggregate mixed with a flame-effects modifier such as fragments of expanded metal net made from magnesium alloy foil. In a preferred embodiment, the aggregate is sand or gravel, and the flame-effects modifier comprises ellipsoids formed from expanded metal sheets made from magnesium alloy foil.

21 Claims, 2 Drawing Sheets

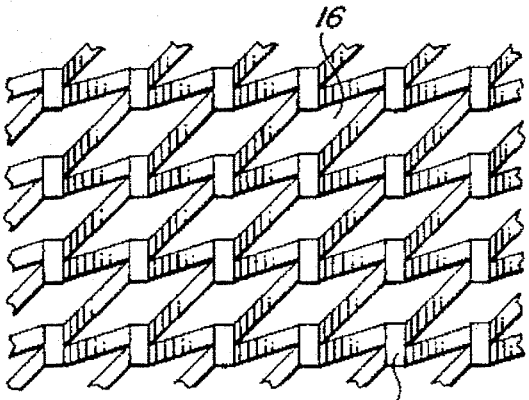
FIG. 5
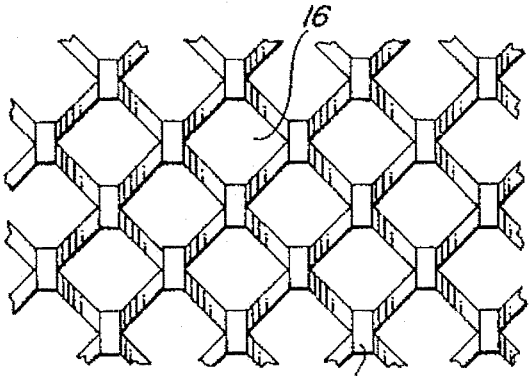
FIG. 6
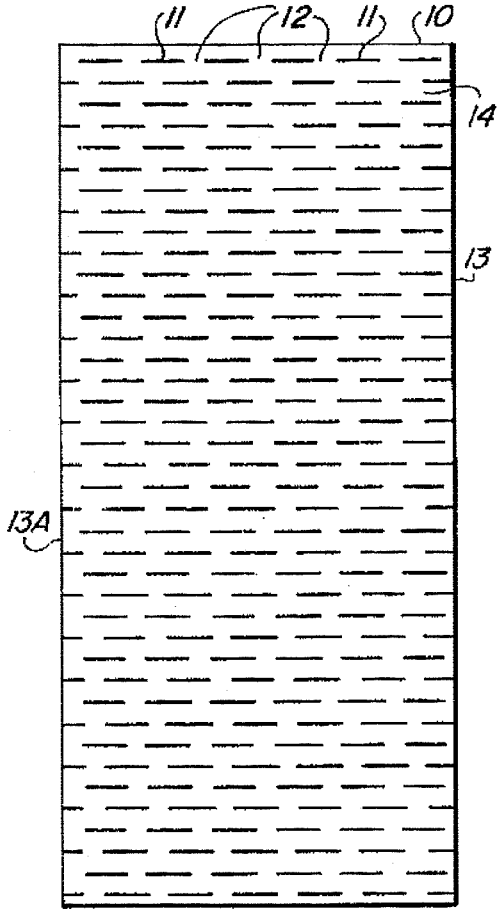
FIG. 2
FIG. 7
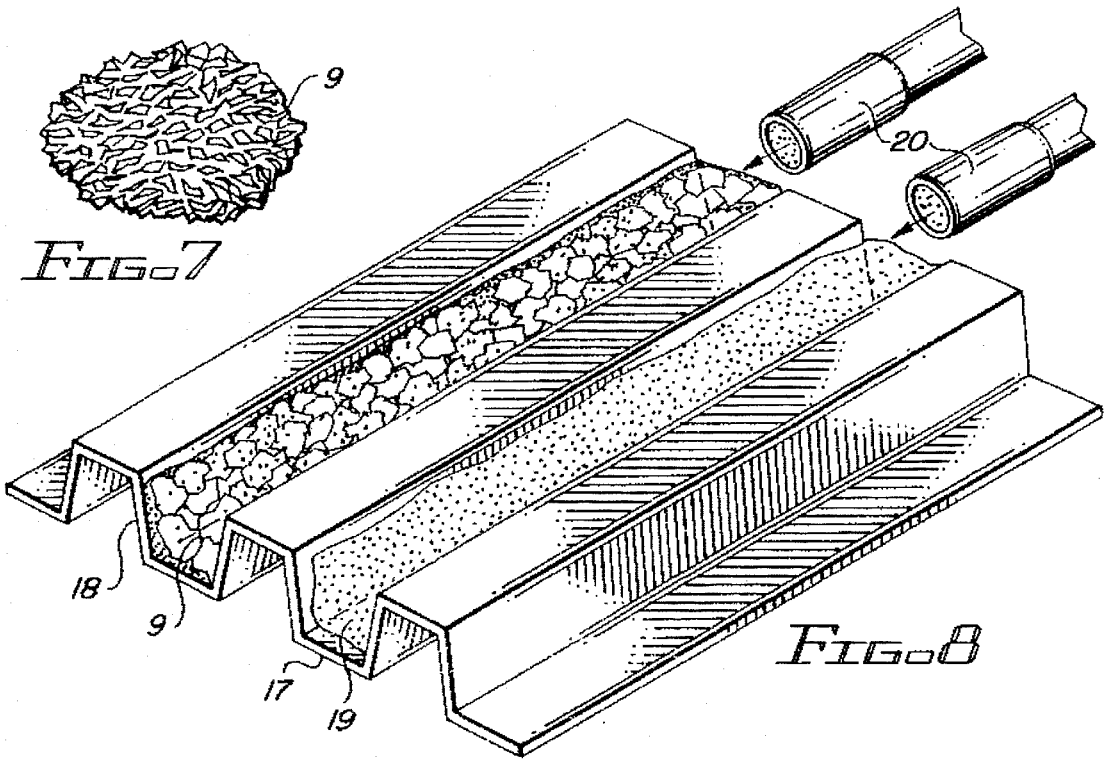
FIG. 8

FUEL CONTAINMENT MEDIUM

This application is a continuation-in-part of application Ser. No. 806,901, filed Dec. 13, 1991, which is a division of application Ser. No. 674,277, filed Mar. 19, 1991 (now U.S. Pat. No. 5,097,907), which was a division of application Ser. No. 417,696, filed Oct. 5, 1989 (now U.S. Pat. No. 5,001,017), which was a continuation of application Ser. No. 280,317, filed Dec. 6, 1988 (now abandoned).

BACKGROUND AND PRIOR ART

The present invention relates to a fuel containment medium that is adapted to protect neighboring facilities against fire or explosion of flammable materials accidentally released from above-ground storage tanks.

Historically, the petrochemical industry has favored the storage of flammable liquids in below-ground tanks. However, because of the magnitude of remediation problems created upon tank failure, the above-ground storage of flammable liquids in tanks has recently become more prevalent. Accompanying the return of fuel storage tanks to the surface is the risk of fires and explosions. Technologies are needed to reduce the incidence or impact of such fires.

Codes specify that the surroundings of above-ground storage tanks have a minimum area and be diked. These regulations are based on tank capacity, type of flammable liquid stored, and type of tank, all of which are the variables which define the repercussions to neighboring facilities if the contents released from a tank accidentally ignite and burn. The diked areas between tanks represent valuable real estate, which may not be available in mature installations. Dikes are sized primarily on the basis of their containing the capacity of a tank upon failure. Where possible, dikes are oversized to moderate, to some extent, the impact of spill fires on nearest neighbors. The impact of fire is diminished as tank spacing is increased.

The size of areas to be established around above-ground storage tanks is calculated using the structural integrity of steel-walled tank surfaces as a function of heat fluxes generated by pool fires in dikes containing flammable liquids. These heat fluxes, which are mostly radiative, increase as the height of the fire and its spread rate increase. If such radiative heat fluxes could be reduced, by reducing flame heights and spread rates in dikes, new tanks might be located closer together, and those now in place made safer.

It is an object of the present invention to provide a fuel containment medium which, when filled in the diked areas surrounding above-ground tanks for flammable liquid, effectively suppresses flame heights and spread rates of pool fires in said diked areas.

It is another object of the invention to inhibit the explosiveness of the spilled fuel in said areas.

It is a further object of the invention to provide a fuel containment medium which is not only effective for the above purposes, but which is simple and inexpensive to manufacture and is easy to install and maintain.

It is a still further object of the invention to provide methods and systems for the use of said containment medium.

Other objects and advantages of the invention will become apparent as the specification proceeds.

SUMMARY OF THE INVENTION

This invention is based on the discovery that the flame height and spread rate of pool fires in dikes containing flammable liquids can be substantially reduced or eliminated by filling the diked containment area with a new and improved containment medium comprising a mineral aggregate mixed with fragments of expanded metal sheet made from magnesium alloy foil.

It has been found that the burning and explosive characteristics of fuel which is held in the containment medium of the present invention are substantially modified, such that, if ignited, the radiative heat fluxes emanating from the flame are substantially retarded, and the danger to neighboring facilities is concomitantly reduced or eliminated.

The product of the present invention therefore is a fuel containment medium comprising a mineral aggregate mixed with fragments of expanded metal sheet made from magnesium foil. In a preferred embodiment, the mineral aggregate is sand or gravel, and the flame-effects modifier comprises ellipsoids formed from expanded metal sheets made from magnesium alloy foil.

The invention also contemplates a method for protecting neighboring facilities against fire or explosion of flammable materials accidentally released from an above-ground storage tank, such method comprising the steps of filling the area around said storage tank with the containment media of the present invention.

BRIEF DESCRIPTION OF THE DRAWINGS

FIG. 2 is a top view of a slitted magnesium alloy foil sheet, which can be expanded by stretching to provide the expanded metal net usable in the present invention.

FIGS. 3 through 6 are top views of the expanded metal net, showing the changes in configuration as the slitted sheet is pulled to open up the expanded metal net.

FIG. 7 is a perspective view showing the ellipsoid form made from the expanded metal net, for use in the present invention.

FIG. 8 is a view of testing apparatus used to demonstrate the difference between fire effects of fuels burned with and without the containment medium of the present invention.

DETAILED DESCRIPTION OF THE INVENTION

Figure 1A:
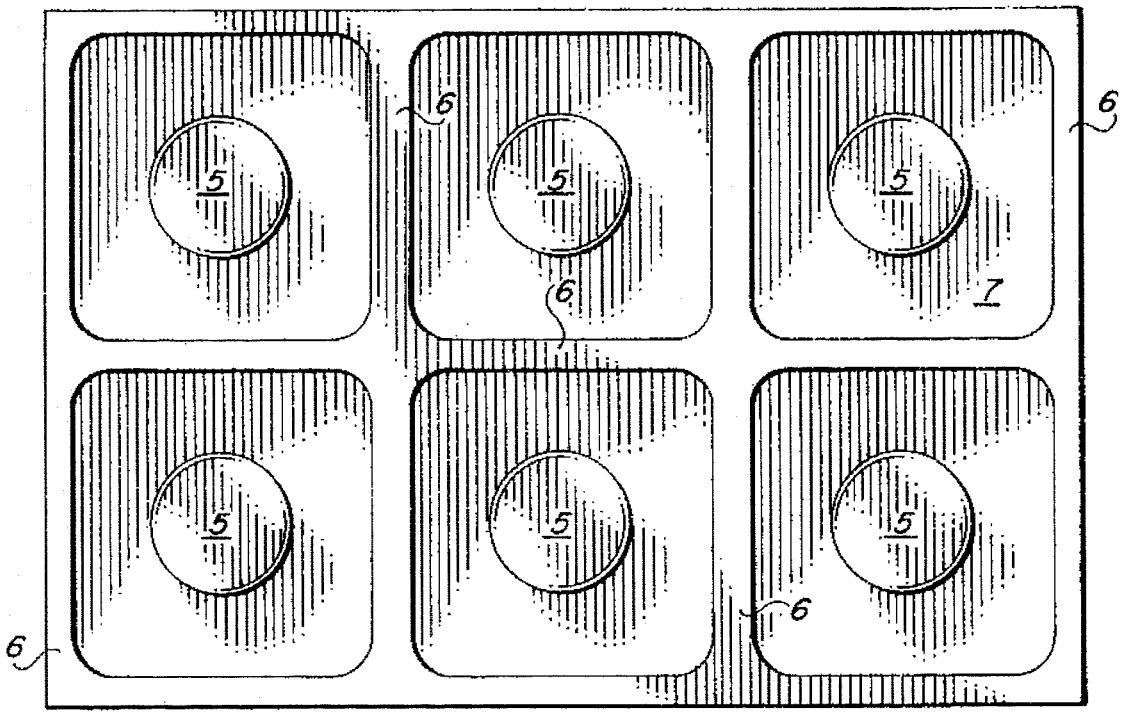
FIG. 1A is a top plan drawing of a section of a fuel tank farm showing diked areas surrounding each of the tanks, the diked areas holding the fuel containment medium of the present invention.

Although the invention is applicable to numerous uses and structures, the basic concepts will be described in detail in connection with the fuel tank farm systems shown in the accompanying drawings. Thus, in FIG. 1A there is a schematic illustration of a tank farm in which the storage tanks 5 are surrounded by dikes 6 to provide the diked areas 7. In the event of rupture of one of the tanks 5, fuel which escapes from the tank is confined by the dikes 6 to the immediate area surrounding the ruptured tank, thus reducing the risk of damaging or otherwise involving neighboring tanks in the event the errant fuel is ignited. However, the problem is that the normal flame effects of burning fuel dictate that the tanks be spaced apart for large distances, using up valuable real estate, in order for the diking arrangement to be effective.

Figure 1B:
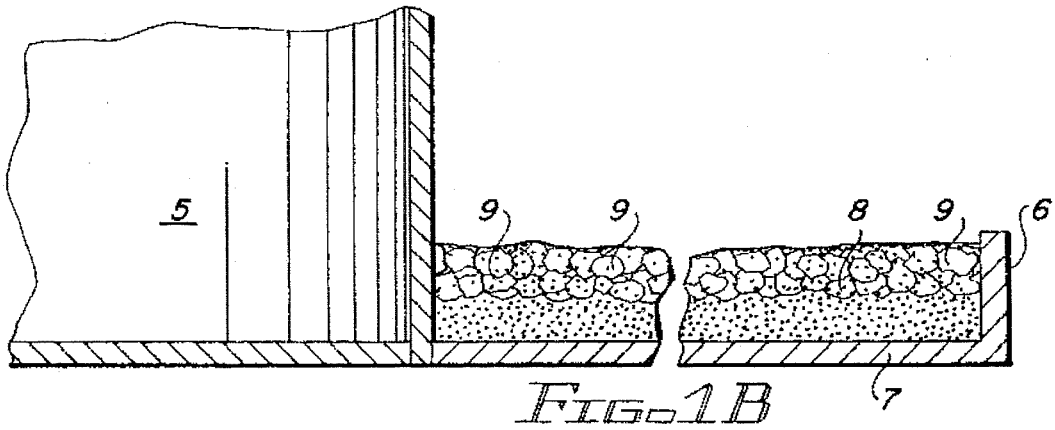
FIG. 1B is a fragmentary cross-section side view showing a fuel tank and part of an associated diked area filled with the containment medium of the invention.

In the present invention, as shown in FIG. 1B, the problem is alleviated by filling the diked area 7 with a containment medium 8, which is a mixture of a mineral aggregate and fragments of expanded metal sheet made from magnesium alloy foil. The aggregate may be any suitable non-combustible, fine-grained particulate material which can serve as a matrix to hold the expanded metal sheet fragments. To provide stability and durability, it is preferred to utilize a fairly dense, fine-grained aggregate having a specific gravity greater than 1. Materials such as sand, gravel, silica, and the like are suitable for this purpose. However, for certain applications, it may be desirable to use lighter aggregates made of materials such as perlite, vermiculite, pumicite, scoria, haydite, cellular glass nodules, and other similar aggregates of porous character.

The containment medium 8 of the present invention is made by mixing the mineral aggregate with small fragments of expanded metal foil. In the preferred embodiment, the expanded metal foil is formed into small ellipsoids 9, as shown in FIGS. 1B and 7. The expanded metal employed in producing the fragments or ellipsoids is formed by slitting a continuous sheet of magnesium alloy metal foil in a specialized manner and then stretching the slitted sheet to convert it to an expanded prismatic metal net having a thickness substantially greater than the thickness of the foil. Referring to the drawings, FIG. 2 shows a sheet of metal foil 10 provided with discontinuous slits appropriate for the present invention.

As noted in FIG. 2, sheet 10 is provided with discontinuous slits 11 in spaced apart lines which are parallel to each other but transverse to the longitudinal dimension of the sheet 10. The slits 11 in each line are separated by unslit segments or gaps 12, and it will be noted that the slits 11 in each line are offset from the slits 11 in adjacent lines. Similarly, the gaps 12 in each line are offset from the gaps 12 in adjacent lines. The lines of slits run parallel to the longitudinal edges 13 and 13A of the continuous sheet of metal foil. Methods and apparatus for producing the slitted metal foil are described in detail in U.S. Pat. No. 5,095,597, dated Mar. 17, 1992 and U.S. Pat. No. 5,142,735, dated Sep. 1, 1992.

Figure 3:
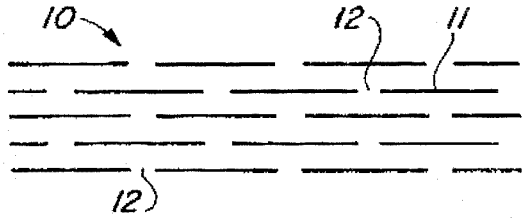
Figure 4:
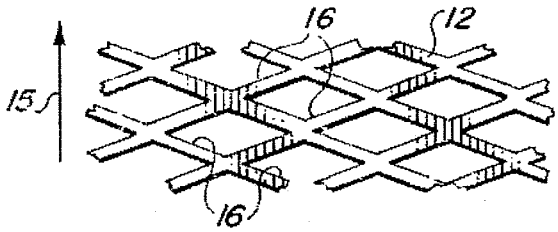

When the slitted metal foil as shown in FIG. 2 is stretched by subjecting it to longitudinal tension, it is converted into an expanded metal prismatic net, usable in the present invention. In the stretching procedure, the horizontal surfaces of foil are raised to a vertical position, taking on a honeycomb-like structure. This conversion is shown in FIGS. 3 through 6 of the drawings. The slitted metal foil 10 is shown in FIG. 3 prior to stretching. When longitudinal tension is applied in the direction of arrow 15, the slits 11 begin to open and are converted to eyes 16, and the product assumes the appearance shown in FIG. 4. The application of more tension causes a greater opening of the slits, and the product expands into the honeycomb-like, prismatic form shown in FIG. 5. When even further tension is applied, the configuration reaches its desired end point, as in FIG. 6. The conversion illustrated in FIGS. 3 through 6 is accompanied by an increase in thickness of the product, the final thickness of the honeycomb product being approximately twice the value of the space 14 between each line of slits. Each eye of the expanded sheet has a three-dimensional structure having eight corner points.

The expanded metal foil used in the present invention is produced by cutting the expanded metal net sheets into small segments, which can themselves be mixed with the mineral aggregate, or which can be further processed by mechanically forming them into the small ellipsoids 9. The ellipsoids 9 generally have a short diameter in the range of 20 to 30 mm, and a long diameter in the range of 30 to 45 mm, with the distance between focal points measuring approximately two-thirds of the long diameter of the ellipsoid. Their ellipsoid shape causes them to nestle closely together when placed in a mixture with aggregate. Apparatus for producing these ellipsoids is described in detail in U.S. Pat. No. 5,207,756, dated May 4, 1993.

For the containment medium usage of the present invention, it is desired that the metal foil be very thin and that the slits in each line and the spaces between the lines be very small. Thus, the thickness of the foil used to produce the metal net should be in the range between 0.028 and 2.0 mm, and the preferred thickness is between 0.20 and 1.0 mm. The length of each slit 11 is in the range between 1 and 2.5 cm, and the unslit sections or gaps 12 between each slit are in the range between 2 to 6 mm long. The distance separating lines of slits may be varied, depending on the thickness desired for the resulting expanded metal net. The distance 14 is ordinarily in the range between 1 and 4 mm, so that the thickness of the resulting expanded metal net is normally in the range between about 2 and 8 mm. The preferred value for distance 14 is either 1 mm or 2 mm.

The kind of metal used in the metal foil should be an alloy of magnesium with suitable compatible substances. Thus, for example, it is desirable to use an alloy of magnesium with substances such as aluminum, copper, zirconium, zinc, strontium, Rn(electron), silicon, titanium, iron, manganese, chromium, and combinations thereof. Alloys such as the above have the valuable characteristic of not only being lightweight, strong, elastic, heat-conductive, etc., but also the important characteristic of being nonflammable at high temperatures. A particularly useful combination is the alloy of magnesium with aluminum and copper. Another preferred combination is the alloy of magnesium with zirconium and strontium. The invention is illustrated in a specific example by an alloy comprising 0 25% Si, 0.3% Fe, 0.01% Cu, 0.01% Mn, 10% Al, 0.1% Zn, 0.08% Ti, and the remainder Mg. Such a product possess tensile strength of 300 N/mm, proof stress of 200 n/mm, elongation of 10%, and Brinell hardness of (5/250-30).

For certain uses, the expanded metal foil used in the present invention may he combined with other materials. For example, if the foil is coated with an alkaline bichromate, the resulting expanded metal net acts as a corrosion inhihitor, since the bichromate acts to remove water from the environment. Further, if the metal foil is combined with oleates or similar compounds, the fire extinguishing capability of the expanded metal net is enhanced, since the oleate emits a dense vapor which assists in smothering the flame.

Any suitable method may be used to mix the aggregate and the fragments or ellipsoids of expanded metal foil, and fill the mixture into the diked area, although it is preferred that, in the resulting configuration there is a surface layer containing a substantial proportion of expanded metal foil. Thus, in one configuration, the aggregate and expanded metal foil components may be mixed uniformly and filled into the diked area so that the filled layer is uniform in proportion of components from top to bottom; or, in another configuration, a base layer of aggregated may be formed first and then covered with a surface layer comprising the expanded metal foil component or a mixture of aggregate and expanded metal foil component. For most efficient results, it is preferred that a substantial proportion of the expanded metal foil component be located at or adjacent the surface of the medium.

The proportions of the mineral aggregate and the expanded metal foil component may vary between wide ranges, depending on the configuration of the dike, the character and nature of the fuel being stored, the climactic conditions, and the like. The mineral aggregate, being fine-grained and dense, tends to fill the interstices in the expanded metal foil component and thus will ordinarily constitute the major proportion, by weight, of the mixture. It is preferred, however, to use a sufficient proportion of the expanded metal foil component to form a continuous layer of the material near the surface, with as few gaps as possible through which flame can pass. When the ellipsoid form of the expanded metal foil is used, the nestling properties of the ellipsoids assist in achieving the desired continuous, gap-free configuration. The amount of containment media, the height of the dikes, and the size of the diked areas should be such that, in the event of tank rupture, the capacity of the tank can be accommodated within the dike by saturation of the medium without formation of pools on top of the media.

It is a feature of the present invention that, when errant fuel from the tank spills into the containment medium and ignites, the flame height and spreading characteristics are drastically reduced by the action of the medium, with the result that the radiative heat fluxes from the flame are minimized and present a substantially reduced danger to neighboring facilities. The effectiveness of the containment medium of the present invention has been demonstrated in tests utilizing the equipment shown in FIG. 8. Preparation for the testing consisted of loading a pair of 150-cm (5-ft) long, 8-cm (3-in) wide, 10-cm (4-in) deep channels 17 and 18 in a metal trough. Channel 17 was filled with sand 19. Channel 18 was filled with a mixture of sand and ellipsoids 9 formed from expanded metal sheet made from magnesium alloy foil, such that the tops of the ellipsoids were exposed at surface level. The sand in each channel was then saturated with gasoline such that its surface was wet, but with no excess appearing as a pool. Twenty-four tests were conducted, each test consisting of simultaneously igniting one end of each channel with a torch flame 20, as shown in FIG. 8. The end ignited was varied to avoid bias from non-uniformities in the surfaces, and from ambient winds.

Flame spread rates and heights were determined from videotapes and photographs of each of the 24 tests conducted. On average, within an uncertainty of ±15%, the presence of the ellipsoids at the surface of the gasoline-saturated sand reduced flame spread rate by a factor of ~2, and flame height by a factor of ~3. The results provide compelling evidence of the fire-effects moderation capacity of the containment medium of the present invention, which consists of a dramatic retardation in flame spread rate and lowering of flame height.

The containment medium of the invention provides numerous advantages which enable development of a revised approach to the protection of fuel storage tanks. The product itself is economical, non-toxic, non-flammable, non-corrosive, durable to environmental forces, and is easy to apply and maintain. Further, it provides the fire-effects moderation that has been demonstrated, and in addition is capable of suppressing explosions when the contained fuel is subjected to explosion-promoting conditions.

Although various preferred embodiments of the invention have been described in detail, it will be understood by those skilled in the art that variations may be made without departing from the spirit of the invention. Although the invention has been described primarily in terms of containing fuel spills in tank farm systems, it will be understood that it can also be used in other industrial or manufacturing settings where tanks of flammable materials are used for supply or storage or where fugitive flammable substances may be encountered.

What is claimed is:

1. A fuel containment medium comprising at least one layer of (a) nestled porous ellipsoids formed from expanded metal sheet made from magnesium alloy foil, and (b) a mineral aggregate mixed with and filling the pores or interstices of said ellipsoids.

2. A fuel containment medium as in claim 1 wherein said mineral aggregate is sand.

3. A fuel containment medium as in claim 1 wherein said mineral aggregate is gravel.

4. A method for protecting neighboring facilities against fire or explosion of flammable materials accidentally released from an above-ground storage tank, comprising the steps of filling the area around said storage tank with a containment medium comprising a mineral aggregate mixed with fragments of expanded metal sheet made from magnesium alloy foil coated with an alkaline bichromate.

5. A fuel containment medium as in claim 1 wherein said magnesium alloy foil has a thickness in the range of about 0.02 to 2.0 mm.

6. A fuel containment medium comprising a mineral aggregate mixed with fragments of expanded metal sheet made from magnesium alloy foil, wherein said fragments of expanded metal sheet are coated with an alkaline bichromate.

7. A fuel containment medium comprising a mineral aggregate mixed with fragments of expanded metal sheet made from magnesium alloy foil, wherein said fragments of expanded metal sheet are coated with an oleate.

8. A fuel containment medium having an internal layer comprising a body of mineral aggregate and a surface layer comprising a mixture of mineral aggregate and nestled porous ellipsoids formed from expanded metal sheet made from magnesium alloy foil, said mineral aggregate filling the pores or interstices of said ellipsoids.

9. An above-ground storage system for flammable materials comprising spaced-apart, above-ground tanks containing said flammable materials, diked areas surrounding each of said tanks, and a containment medium filled in said diked areas, said medium comprising at least one layer of (a) nestled porous ellipsoids formed from expanded metal sheet made from magnesium alloy foil, and (b) a mineral aggregate mixed with and filling the pores or interstices of said ellipsoids.

10. An above-ground storage system as in claim 9 wherein said mineral aggregate is sand.

11. An above-ground storage system as in claim 9 wherein said mineral aggregate is gravel.

12. A method for protecting neighboring facilities against fire or explosion of flammable materials accidentally released from an above-ground storage tank, comprising the steps of filling the area around said storage tank with a containment medium comprising a mineral aggregate mixed with fragments of expanded metal sheet made from magnesium alloy foil coated with an oleate.

13. An above-ground storage system as in claim 9 wherein said magnesium alloy foil has a thickness in the range of about 0.02 to 2.0 mm.

14. An above-ground storage system for flammable materials comprising spaced-apart, above-ground tanks containing said flammable materials, diked areas surrounding each of said tanks, and a containment medium filled in said diked areas, said medium comprising a mineral aggregate mixed with fragments of expanded metal sheet made from magnesium foil, wherein said fragments of expanded metal sheet are coated with an alkaline bichromate.

15. An above-ground storage system for flammable materials comprising spaced-apart, above-ground tanks containing said flammable materials, diked areas surrounding each of said tanks, and a containment medium filled in said diked areas, said medium comprising a mineral aggregate mixed with fragments of expanded metal sheet made from magnesium foil, wherein said fragments of expanded metal sheet are coated with an oleate.

16. An above-ground storage system as in claim 9 wherein said containment medium has an internal layer comprising a body of mineral aggregate and a surface layer comprising a mixture of mineral aggregate and nestled porous ellipsoids formed from expanded metal sheet made from magnesium alloy foil, said mineral aggregate filling the pores or interstices of said ellipsoids.

17. A method for protecting neighboring facilities against fire or explosion of flammable materials accidentally released from an above-ground storage tank, comprising the steps of filling the area around said storage tank with a containment medium comprising at least one layer of (a) nestled porous ellipsoids formed from expanded metal sheet made from magnesium alloy foil, and (b) a mineral aggregate mixed with and filling the pores or interstices of said ellipsoids.

18. A method as in claim 17 wherein said mineral aggregate is sand.

19. A method as in claim 17 wherein said mineral aggregate is gravel.

20. A method as in claim 17 wherein said containment medium has an internal layer comprising a body of mineral aggregate and a surface layer comprising a mixture of mineral aggregate and nestled porous ellipsoids formed from expanded metal sheet made from magnesium alloy foil, said mineral aggregate filling the pores or interstices of said ellipsoids.

21. A method as in claim 17 wherein said magnesium alloy foil has a thickness in the range of about 0.02 to 2.0 mm.

* * * * *